United States Patent [19]

Imanishi et al.

[11] Patent Number: 4,498,310

[45] Date of Patent: Feb. 12, 1985

[54] HEAT PUMP SYSTEM

[75] Inventors: Masami Imanishi, Wakayama; Naoki Tanaka, Hyogo, both of Japan

[73] Assignee: Mitsubishi Denki Kabushiki Kaisha, Tokyo, Japan

[21] Appl. No.: 455,640

[22] Filed: Jan. 5, 1983

[30] Foreign Application Priority Data

Jan. 9, 1982 [JP] Japan ..... 57-2072

[51] Int. Cl.[3] ..... F25B 41/00

[52] U.S. Cl. ..... 62/211; 236/92 B

[58] Field of Search ..... 62/223, 224, 211, 209, 62/DIG. 17; 236/92 B

[56] References Cited

U.S. PATENT DOCUMENTS

| | | | |
|---|---|---|---|
| 4,032,070 | 6/1977 | Nielsen | 236/92 B |
| 4,095,742 | 6/1978 | Schumacher | 236/92 B |
| 4,244,182 | 1/1981 | Behr | 62/223 X |
| 4,283,921 | 8/1981 | Prosky | 62/223 X |

*Primary Examiner*—William E. Wayner
*Assistant Examiner*—J. Sollecito
*Attorney, Agent, or Firm*—Sughrue, Mion, Zinn, Macpeak & Seas

[57] ABSTRACT

A heat pump system in which the amount of opening of an expansion valve is set to an optimum value in dependence upon the inlet temperature of water undergoing heat exchange at a utilization side heat exchanger and an inlet temperature of air undergoing heat exchange at a non-utilization side heat exchanger. In response to the sensed temperature values, a controller determines the optimum amount of valve opening so as to provide a maximum system capacity and efficiency. The controller may be implemented with a microprocessor and a read-only memory. In the read-only memory are stored data values representing optimum opening settings of the expansion valve corresponding to various values of the sensed inlet temperature of water at the utilization side heat exchanger and the inlet temperature of the air at the non-utilization side heat exchanger.

8 Claims, 7 Drawing Figures

HEAT PUMP SYSTEM

BACKGROUND OF THE INVENTION

The present invention relates to a heat pump system in which the opening of an expansion valve is controlled depending upon the temperatures of each medium undergoing heat exchange at utilization side and non-utilization side heat exchangers.

First, a heat pump system of a conventional type will be described. In FIG. 1, the conventional unit includes a compressor 1, a four-way valve 2, a non-utilization side heat exchanger 3 serving as a condenser for cooling and as an evaporator for heating, a fan 4 for supplying a flow of ambient air to the non-utilization side heat exchanger 3, an expansion valve 5 of the temperature type, a temperature sensor 6 attached to the inlet piping 7 of the compressor 1, a pressure equalizer 8 of the expansion valve 5 connected to the inlet piping 7, a utilization side heat exchanger 9 serving as an evaporator for cooling and as a condenser for heating, and an accumulator 10.

The operation of this system during cooling will now be described. As indicated by solid-line arrows in FIG. 1, the refrigerant gas discharged from the compressor 1 flows to the non-utilization side heat exchanger 3 through the four-way valve 2 where it exchanges heat with air supplied by the fan 4 and is thereby condensed. The condensed refrigerant then flows to the utilization side heat exchanger 9 passing through a first check valve 21, the expansion valve 5 where its pressure is reduced, and a second check valve 22. In the utilization side heat exchanger 9, the refrigerant exchanges heat with water flowing in the heat exchanger 9, thereby cooling the water. The cooled water is then used to cool a room or rooms through a fan coil unit (not shown), etc. The refrigerant, after being evaporated in the utilization side heat exchanger 9 due to heat exchange with the water, returns to the compressor 1 through the four-way valve 2 and the accumulator 10.

Next, the operation of the system during heating will be described. As indicated by dotted-line arrows, the refrigerant gas discharged from the compressor 1 flows through the four-way valve 2 to the utilization side heat exchanger 9 where it exchanges its heat with the water flowing in the heat exchanger 9 to thus heat the water. The heated water is circulated in the room to heat the room through the fan coil unit in a manner similar to that used for air conditioning. The refrigerant is condensed in the utilization side heat exchanger 9 due to heat exchange with the water. Then, it is passed to the non-utilization side heat exchanger 3 through a third check valve 23, the expansion valve 5 where its pressure is reduced, and a fourth check valve 24. In the non-utilization side heat exchanger 3, the refrigerant is evaporated due to heat exchange with the air supplied by the fan 4, and then returned to the compressor 1 through the four-way valve 2 and the accumulator 10.

In the above-discussed system, the amount of opening of the expansion valve 5 is determined so as to control the flow of refrigerant in dependence upon the temperature difference, or amount of superheating, between the temperature of the refrigerant in the inlet piping 7 of the compressor 1 and the saturation temperature at the refrigerant pressure. Consequently, the degree of opening is governed solely by the conditions at the low pressure side, with substantially no response to changes in the conditions on the high pressure side. With the construction of a conventional heat pump unit described above, if conditions should change suddenly, for instance, due to a shower while operating in the cooling mode in the summer, the non-utilization side heat exchanger 3 will be cooled rapidly and, consequently, the pressure on the high pressure side lowered. However, the amount of opening of the expansion valve 5 is kept constant. Therefore, the flow rate of the circulating refrigerant decreases due to the reduced pressure difference between the high and low pressures, and also the pressure on the low pressure side drops, resulting in a reduction of cooling capacity.

In the heating mode, particularly during starting of the system, the utilization side heat exchanger 9 is cooled due to the low temperature of the circulating water, and hence the pressure on the high pressure side is low. Therefore, as in the case of cooling mentioned above, the pressure on the low pressure side drops, and the evaporation temperature of the non-utilization side heat exchanger 3 is reduced, causing frosting on the non-utilization side heat exchanger 3. As a result, frequent removal of frost is required, and the temperature of the water in the utilization side heat exchanger 9 cannot rise rapidly.

SUMMARY OF THE INVENTION

In accordance with this and other objects of the invention, there is provided a heat pump system including a utilization side heat exchanger, a non-utilization side heat exchanger, a compressor for compressing and circulating a refrigerant fluid through the utilization side heat exchanger and the non-utilization side heat exchanger, a four-way valve for controlling a direction of refrigerant fluid flow through the utilization side heat exchanger and the non-utilization side heat exchanger, and an expansion valve provided between the utilization side heat exchanger and the non-utilization side heat exchanger for selectively controlling the circulation rate of the refrigerant fluid in accordance with an amount of valve opening of the expansion valve, wherein the improvement comprises the provision of sensing means for detecting predetermined ones of temperatures and pressures of media undergoing heat exchange at the utilization side heat exchanger and at the non-utilization side heat exchanger, and controller means for controlling the amount of opening of the expansion valve in accordance with the sensed predetermined ones of the temperatures and pressures.

In a disclosed preferred embodiment, the predetermined ones of the temperatures and pressures of the media undergoing heat exchange are the inlet temperature of water undergoing heat exchange at the utilization side heat exchanger and the inlet temperature of air undergoing heat exchange at the non-utilization side heat exchanger. Also, the temperature of the oil in the compressor may be sensed, and if this temperature exceeds a preset-value, the opening of the expansion valve is increased, with precedence over the other sensed parameters. This prevents backflow of refrigerant fluid into the pump and overheating of the pump.

The controlling means may be implemented with a microprocessor and a read-only memory. In the read-only memory are stored data representing opening settings of the expansion valve corresponding to various values of the sensed inlet temperature of water at the utilization side heat exchanger and the inlet temperature of the air at the non-utilization side heat exchanger.

DESCRIPTION OF THE PREFERRED EMBODIMENTS

Figure 4:
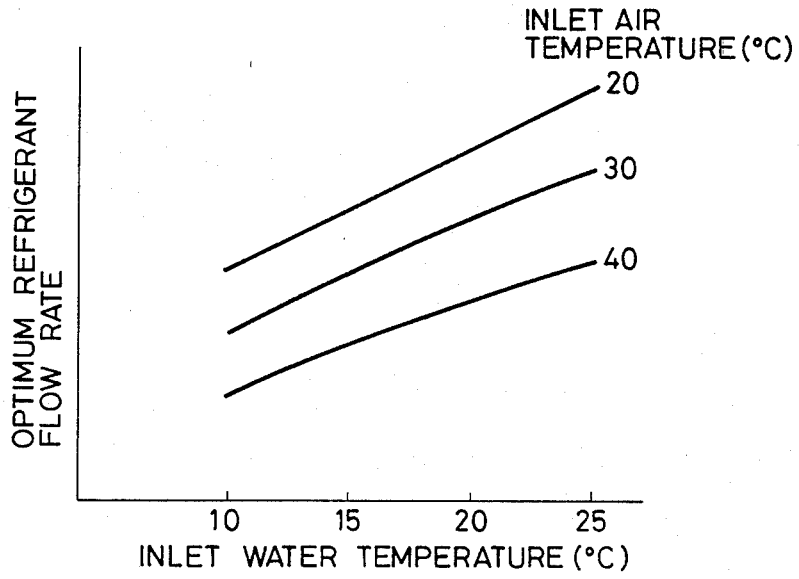
FIGS. 4 and 5 are graphs showing optimum refrigerant circulation rates for cooling and heating, respectively, as a function of inlet water temperature.
Figure 5:
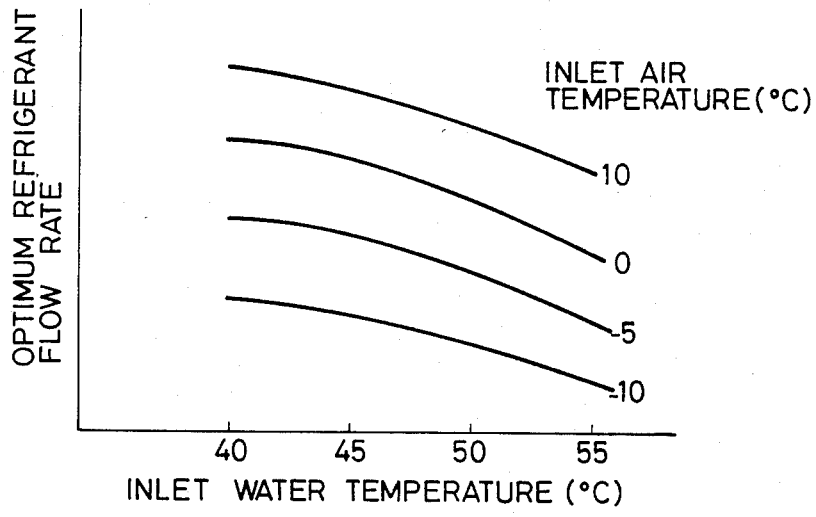

Before describing the structure and operation of a preferred embodiment of the invention, a general description of an optimum refrigerant flow rate (the refrigerant flow rate which provides the maximum heat transfer capacity under given conditions) will be given. Generally, in a refrigeration cycle, from a knowledge of the high pressure conditions and low pressure conditions, the optimum capacity of the compressor used in the system can be determined. Assuming that heat exchangers which are capable of handling this capacity are provided, the optimum refrigerant flow rate can then be determined. Representing the high pressure conditions and low pressure conditions by the inlet air temperature and inlet water temperature, respectively, the optimum refrigerant flow rates for cooling and heating as functions of inlet water temperatures and with inlet air temperatures as parameters are shown by the graphs of FIGS. 4 and 5, respectively.

Figure 1:
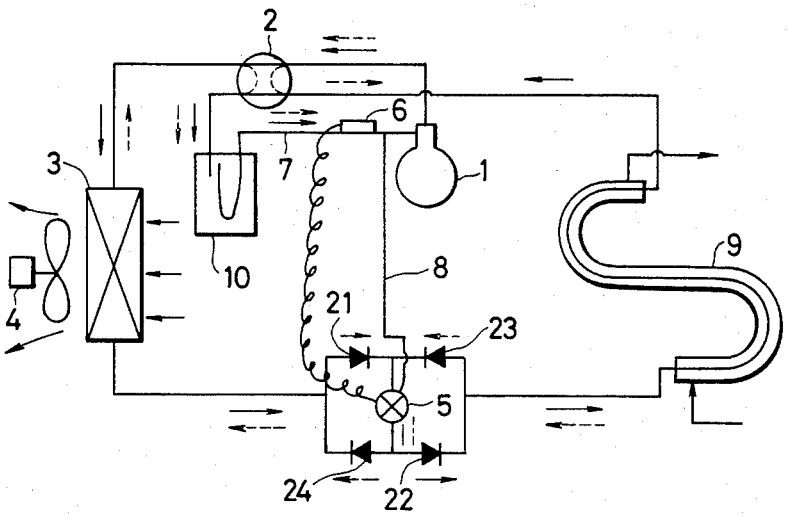
PRIOR ART FIG. 1
FIG. 1 is a diagram depicting a conventional heat pump system.
Figure 2:
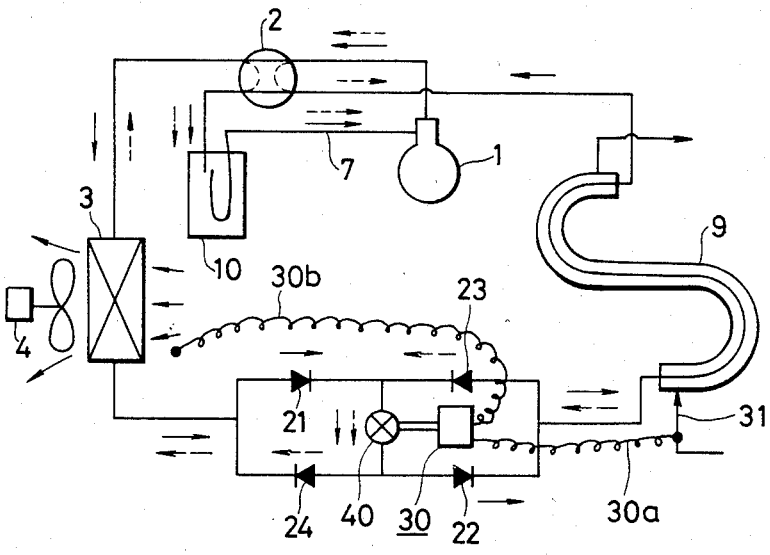
FIG. 2 is a diagram showing a heat pump of a first preferred embodiment of the present invention.

A preferred embodiment of a heat pump system of the invention will now be described with reference to FIG. 2. In FIG. 2, reference numerals used commonly with FIG. 1 represent like components, and hence further description of those components will be omitted.

The heat pump system of the invention includes a controller 30 which detects the inlet temperature of the medium (water) undergoing heat exchange at the utilization side heat exchanger 9 and the inlet temperature of the medium (air) undergoing heat exchange at the non-utilization side heat exchanger 3 with temperature sensors 30*a* and 30*b*, respectively. The amount of opening of a thermoelectric expansion valve 40 is controlled with output signals produced in response to the sensed values.

The operation of the above-mentioned preferred embodiment of the invention will now be described. As shown in FIG. 2, for cooling, the refrigerant gas discharged from the compressor 1 flows through the four-way valve 2, the non-utilization side heat exchanger 3 where it is condensed, the thermoelectric expansion valve 40 where its pressure is reduced, the utilization side heat exchanger 9 where it is evaporated; the four-way valve 2, the accumulator 10, and then back to the compressor 1.

Figure 6:
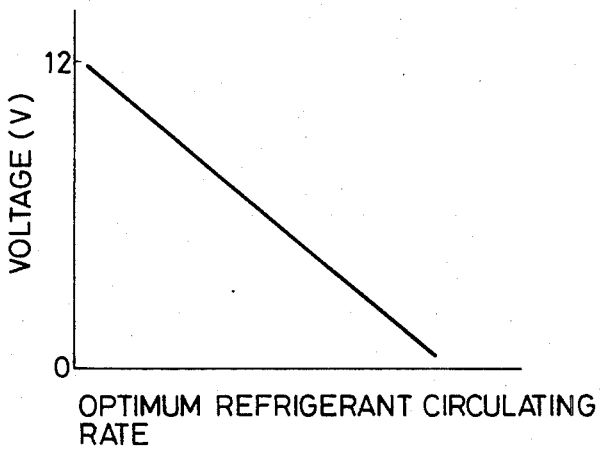
FIGS. 6 and 7 are graphs showing the relationship between the optimum refrigerant circulation rate and a voltage applied to control the amount of opening of an expansion valve.

The refrigerant circulation rate is controlled as follows. First, the inlet air temperature (the conditions on the high pressure side) at the non-utilization side heat exchanger 3 and the inlet water temperature (the conditions on the low pressure side) at the utilization side heat exchanger 9 are detected by the temperature sensors 30*b* and 30*a*, respectively. The controller 30 then determines the optimum refrigerant flow rate based upon the relationship between the several temperatures and the optimum refrigerant flow rate shown in the graph of FIG. 4. Next, the controller 30 outputs a control voltage which is applied to control the expansion valve with the magnitude of this voltage being determined by the relationship between the optimum refrigerant flow rate and voltage as shown in FIG. 6. The thermoelectric expansion valve 40 is thus set to the proper valve opening to ensure the optimum refrigerant flow.

With this arrangement, even if the inlet air temperature at the non-utilization side heat exchanger 3 drops suddenly due to a shower, etc., because the controller substantially instantly performs the value opening setting operation in the manner described above, the pressure on the low pressure side is appropriately set to make the condensed liquid refrigerant flow to the low pressure side.

On the other hand, for heating, the refrigerant gas discharged from the compressor 1 flows through the four-way valve 2, the utilization side heat exchanger 9 where it is condensed, the thermoelectric expansion valve 40 where its pressure is reduced, the non-utilization side heat exchanger 3 where it is evaporated, the four-way valve 2, and finally through the accumulator 10 before being returned to the compressor 1.

Figure 7:
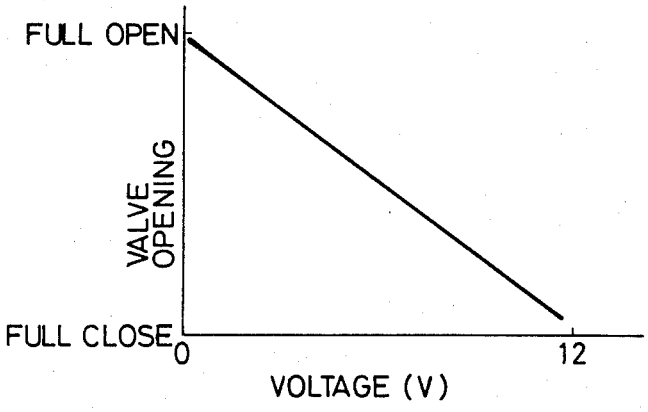

The refrigerant circulating rate in this case is controlled as follows. The inlet water temperature (the conditions on the high pressure side) at the utilization side heat exchanger 9 and the inlet air temperature (the conditions on the low pressure side) at the non-utilization side heat exchanger 3 are detected by the temperature sensors 30*a* and 30*b*, respectively. From the signals produced by the sensors 30*a* and 30*b* representing the sensed temperatures, the controller 30 determines the optimum refrigerant circulation rate from stored data (depicted graphically in FIG. 5) and generates a voltage (as indicated in FIG. 6) which is applied to the expansion valve 40 to thus set the optimum refrigerant circulating rate. The amount of opening of the expansion valve 40 is specified by the graph of FIG. 7.

When starting the system on a winter morning (with a water temperature of, for instance, 5° C.), the controller 30 outputs a voltage which makes the opening of the expansion valve 40 larger so that the condensed liquid refrigerant flows toward the low pressure side. As a result, the heating surface area of the utilization side heat exchanger 9 is most effectively utilized (for condensation) to increase the system capacity, while excessive lowering of the pressure on the lower pressure side is prevented to limit the amount of frost produced.

Figure 3:
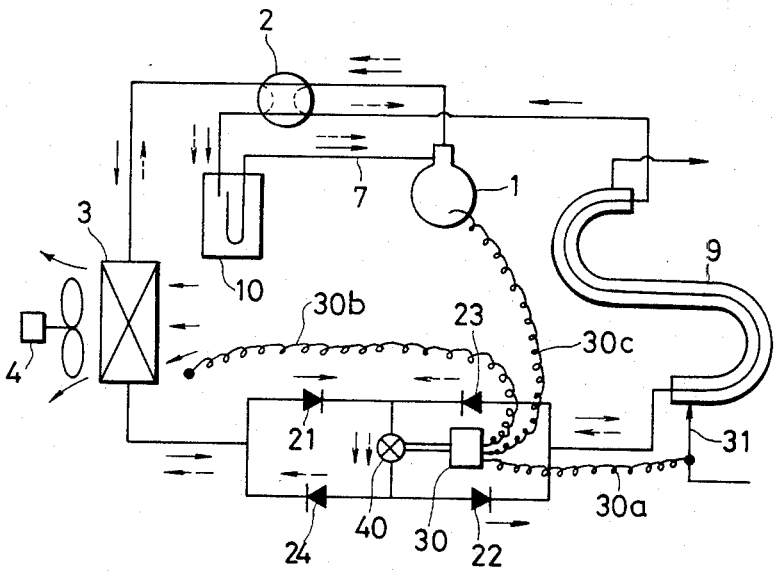
FIG. 3 is a diagram showing a heat pump of a second preferred embodiment of the present invention.

A modification of the embodiment of FIG. 2 is shown in FIG. 3. In the embodiment of FIG. 3, the temperature of the oil in the compressor 1 is sensed and communicated to the controller 30 on a line 30*c*. When the oil temperature exceeds a preset limit, the controller 30 acts to increase the amount of opening of the expansion valve 40, regardless of what is instructed by the other inputs to the controller 30. This prevents backflow of refrigerant fluid into the compressor 1 and overheating of the compressor 1.

The controller 30 can be implemented with a microprocessor and an associated read-only memory in which data corresponding to the graphs of FIGS. 4–6 is stored. In this arrangement, the sensed temperature values are supplied as inputs to the microprocessor. From these values, the microprocessor peforms a look-up operation upon the data stored in the read-only memory to determine the correct value for the control voltage to be applied to the expansion valve 40. A digital value outputted by the microprocessor representing the control voltage is converted to an analog signal in a well-known manner for application to the expansion valve 40.

The invention is not limited to the aforementioned embodiments in which the inlet water temperature and inlet air temperature at the utilization side and non-utilization side heat exchangers are detected. Within the scope of the invention, other conditions on the high pressure side and on the low pressure side may be detected, for example, condensation temperature and/or pressure and evaporation temperature and/or pressure, with the controller issuing the required signals for controlling the opening of expansion valve on the basis of those conditions. Accordingly, it is possible to always provide an optimum refrigerant circulation rate, and to ensure optimum operation even when conditions change suddenly during cooling or during starting of the system for heating.

We claim:

1. A heat pump system including a utilization side heat exchanger, a non-utilization side heat exchanger, a compressor for compressing and circulating a refrigerant fluid through said utilization side heat exchanger and said non-utilization side heat exchanger, a four-way valve for controlling a direction of refrigerant fluid flow through said utilization side heat exchanger and said non-utilization side heat exchanger, and an expansion valve provided between said utilization side heat exchanger and said non-utilization side heat exchanger for selectively controlling the circulation rate of said refrigerant fluid in accordance with an amount of valve opening of said expansion valve, wherein the improvement comprises:

sensing means for detecting only a predetermined temperature of media undergoing heat exchange at said utilization side heat exchanger and a predetermined temperature of media undergoing heat exchange with said refrigerant at said non-utilization side heat exchanger regardless of said direction of refrigerant fluid flow; and controller means for controlling said amount of opening of said expansion valve in accordance with the sensed predetermined temperatures.

2. The heat pump system of claim 1, further comprising means for detecting a temperature of oil in said compressor, said controller means increasing said amount of opening of said expansion valve when the detected temperature of said oil exceeds a predetermined value.

3. The heat pump system of claim 1, wherein said controller means comprises a microprocessor and a read-only memory.

4. A heat pump system including a utilization side heat exchanger, a non-utilization side heat exchanger, a compressor for compressing and circulating a refrigerant fluid through said utilization side heat exchanger and said non-utilization side heat exchanger, a four-way valve for controlling a direction of refrigerant fluid flow through said utilization side heat exchanger and said non-utilization side heat exchanger, and an expansion valve provided between said utilization side heat exchanger and said non-utilization side heat exchanger for selectively controlling the circulation rate of said refrigerant fluid in accordance with an amount of valve opening of said expansion valve, wherein the improvement comprises:

sensing means for detecting an inlet temperature of water undergoing heat exchange at said utilization side heat exchanger and an inlet temperature of air undergoing heat exchange at said non-utilization side heat exchanger; and controller means for controlling said amount of opening of said expansion valve in accordance with the sensed air and water temperatures.

5. The heat pump system of claim 4, further comprising means for detecting a temperature of oil in said compressor, said controller means increasing said amount of opening of said expansion valve when the detected temperature of said oil exceeds a predetermined value.

6. The heat pump system of claim 4, wherein said controller means comprises a microprocessor and a read-only memory.

7. A heat pump system including a utilization side heat exchanger, a non-utilization side heat exchanger, a compressor for compressing and circulating a refrigerant fluid through said utilization side heat exchanger and said non-utilization side heat exchanger, a four-way valve for controlling a direction of refrigerant fluid flow through said utilization side heat exchanger and said non-utilization side heat exchanger, and an expansion valve provided between said utilization side heat exchanger and said non-utilization side heat exchanger for selectively controlling the circulation rate of said refrigerant fluid in accordance with an amount of valve opening of said expansion valve, wherein the improvement comprises:

sensing means for detecting an inlet temperature of water undergoing heat exchange at said utilization side heat exchanger and an inlet temperature of air undergoing heat exchange at said non-utilization side heat exchanger; and controller means comprising a microprocessor and a read-only memory for controlling said amount of opening of said expansion valve in accordance with the sensed air and water temperatures, wherein said read-only memory stores data representing opening settings of said expansion valve corresponding to predetermined values of said inlet temperature of water at said utilization side heat exchanger and said inlet temperature of air at said non-utilization side heat exchanger for providing an optimum value of said expansion valve opening.

8. The heat pump system of claim 7, further comprising means for detecting a temperature of oil in said compressor, said controller means increasing said amount of opening of said expansion valve when the detected temperature of said oil exceeds a predetermined value.

* * * * *